US007354213B2

(12) United States Patent
Iwata et al.

(10) Patent No.: US 7,354,213 B2
(45) Date of Patent: Apr. 8, 2008

(54) PRINTER HAVING FOREIGN MATERIAL REMOVING STRUCTURE

(75) Inventors: Yasuo Iwata, Saitama (JP); Kazumi Hasegawa, Tokyo (JP); Takuro Kohyama, Tokyo (JP)

(73) Assignee: Citizen Holdings Co., Ltd., Tokyo (JP)

( * ) Notice: Subject to any disclaimer, the term of this patent is extended or adjusted under 35 U.S.C. 154(b) by 229 days.

(21) Appl. No.: 11/080,664

(22) Filed: Mar. 16, 2005

(65) Prior Publication Data

US 2005/0206709 A1 Sep. 22, 2005

(30) Foreign Application Priority Data

Mar. 17, 2004 (JP) ..... 2004-075517

(51) Int. Cl.
*B41J 29/00* (2006.01)

(52) U.S. Cl. ..... 400/693; 400/613

(58) Field of Classification Search ..... None
See application file for complete search history.

(56) References Cited

U.S. PATENT DOCUMENTS 4,883,376 A * 11/1989 Iwase et al. ..... 400/83
6,004,053 A * 12/1999 Petteruti et al. ..... 400/693

FOREIGN PATENT DOCUMENTS

| | | | |
|---|---|---|---|
| JP | 06131477 A | * | 5/1994 |
| JP | 2001-130057 | | 5/2001 |
| JP | 2002-137493 | | 5/2002 |
| JP | 2002234231 A | * | 8/2002 |
| JP | 2003008803 A | * | 1/2003 |
| JP | 2003118202 A | * | 4/2003 |

* cited by examiner

*Primary Examiner*—Daniel J. Colilla
(74) *Attorney, Agent, or Firm*—Westerman, Hattori, Daniels & Adrian, LLP.

(57) ABSTRACT

In a printer, a sheet discharge port for discharging a sheet therefrom is provided on the upper surface of an exterior case, and a recess portion for preventing invasion of a foreign material into the sheet discharge port is formed in the neighborhood of the sheet discharge port. The recess portion passes by the sheet discharge port, and at least one of the ends thereof is opened to the side surface of the exterior case. The side surface of the exterior case to which the open end of the recess portion is adjacent forms a foreign material discharging passage along which a foreign material discharged from the open end of the recess portion falls down without invading the printer.

7 Claims, 6 Drawing Sheets

PRINTER HAVING FOREIGN MATERIAL REMOVING STRUCTURE

BACKGROUND OF THE INVENTION

1. Field of the Invention

The present invention relates to a printer equipped with a sheet discharge port for discharging a sheet on the upper surface of an exterior case, and particularly to a printer having a structure for preventing invasion of foreign materials into a sheet discharge port.

2. Description of the Related Art

Recently, printers have been used at various places, and some of them are used while set up in the neighborhood of water-associated places such as kitchens or the like. When a printer is used in the vicinity of such a water-associated place, water droplets may invade the printer from a sheet discharge port. When a water droplet invades the sheet discharge port, the water droplet infiltrates into a sheet before print, and blurs ink on the sheet, so that print quality is lowered. Furthermore, invasion of a water droplet from the sheet discharge port into the printer also damages the internal parts of the printer. If a foreign material adhering to the upper surface of the printer invades the printer from the sheet discharge portion, it may cause breakdown of the printer irrespective of whether the foreign material is a water droplet or not. Therefore, it has been strongly required to provide a structure for effectively preventing invasion of various kinds of foreign materials containing water droplets from the sheet discharge port.

Under such a requirement, a printer having a structure for preventing invasion of a water droplet from the sheet discharge port has been proposed (JP-A-2002-137493).

Here, the printer disclosed in JP-A-2002-137493 is designed as a clam shell type printer in which a front lid body and a rear lid body are opened/closed. In this printer, a sheet discharge recess portion is provided at the boundary portion between the front lid body and the rear lid body, and a slit-shaped sheet discharge port from which roll paper is discharged is provided in the sheet discharge recess portion.

A water discharge groove is formed in the sheet discharge recess portion so as to be located at a lower position than the sheet discharge port. A drain port is formed at the right end portion of the water discharge groove, and water flowing into the sheet discharge recess portion flows along the water discharge groove and is then discharged from the drain port to the outside of the printer.

However, the structure of the printer described above has the following problem.

That is, in order to discharge water flowing into the sheet discharge recess portion, the drain port must be formed at the right end portion of the water discharge groove and further an internal drain port for discharging the water flowing in the drain port to the outside of the printer must be provided. As described above, a complicated structure such as the internal drain port or the like must be provided in the printer, and thus a mold structure used to manufacture printers described above is complicated, so that the manufacturing cost is increased.

SUMMARY OF THE INVENTION

Therefore, the present invention has been implemented in view of the foregoing situation, and has an object to provide a printer which can effectively prevent invasion of foreign materials such as water, etc. into a sheet discharge port with a simple structure.

In order to attain the above object, there is provided a printer having a sheet discharge port which is provided on the upper surface of an exterior case to discharge a sheet therefrom, and a recess portion for preventing invasion of a foreign material into the sheet discharge port is provided on the upper surface of the exterior case, wherein the recess portion is formed so as to pass by the sheet discharge port and at least one end thereof is opened to the side surface of the exterior case.

According to the present invention, the foreign material adhering to the upper surface of the exterior case is captured in the recess portion, and thus the invasion of the foreign material into the sheet discharge port can be prevented in advance. The structure is such a simple structure that the recess portion is merely formed on the upper surface of the exterior case, and thus the design and manufacturing of the printer can be easily performed, so that the manufacturing cost can be reduced.

Furthermore, at least one end of the recess portion is opened to the side surface of the exterior case, and thus foreign materials can be discharged from the open end to the outside of the recess portion.

The "foreign materials" captured in the recess portion contain not only water droplets, but also various kinds of liquid or particulate materials which adversely affect the printer when they invade the sheet discharge port.

If at least one end of the recess portion is opened to the side surface of the exterior case, the cross-sectional shape and the depth dimension thereof may be designed arbitrarily.

The recess portion may be formed over the overall width of the upper surface of the exterior case so that both the ends thereof are opened to both the side surfaces of the exterior case.

Here, it is preferable that the side surface of the exterior case to which the open end of the recess portion is adjacent forms a foreign material discharge passage along which a foreign material discharged from the open end of the recess portion falls down without invading the printer. The foreign material discharge passage as described above may be formed by an additive element such as a groove intercommunicating with the recess portion on the side surface of the exterior case. However, even when the constituent element as described above is not added and the side surface of the exterior case is merely formed by the flat surface having no gap through which foreign materials invade the printer, the side surface functions as the foreign material discharge passage.

Furthermore, if the recess portion is sloped in the width direction so as to be downward inclined to the open end intercommunicating with the side surface, foreign materials captured in the recess portion can be naturally moved along the slope of the recess portion and discharged from the open end.

In the printer in which the upper surface of the exterior has a forward and downward inclined surface and the sheet discharge port is opened to the middle portion of the inclined surface, it is preferable that the open edge portion of the recess portion is located at a higher position than the sheet discharge port.

Furthermore, in the printer in which the upper surface of the exterior case is formed by the front lid body and the rear lid body and the sheet discharge port is opened at the boundary portion between the front lid body and the rear lid body, it is preferable that the recess portion is formed on the surface of the rear lid body.

Still furthermore, a downward extending groove may be provided on the side surface so as to intercommunicate with the open end.

DETAILED DESCRIPTION OF THE PREFERRED EMBODIMENTS

Preferred embodiments according to the present invention will be described hereunder with reference to the accompanying drawings.

Figure 1:
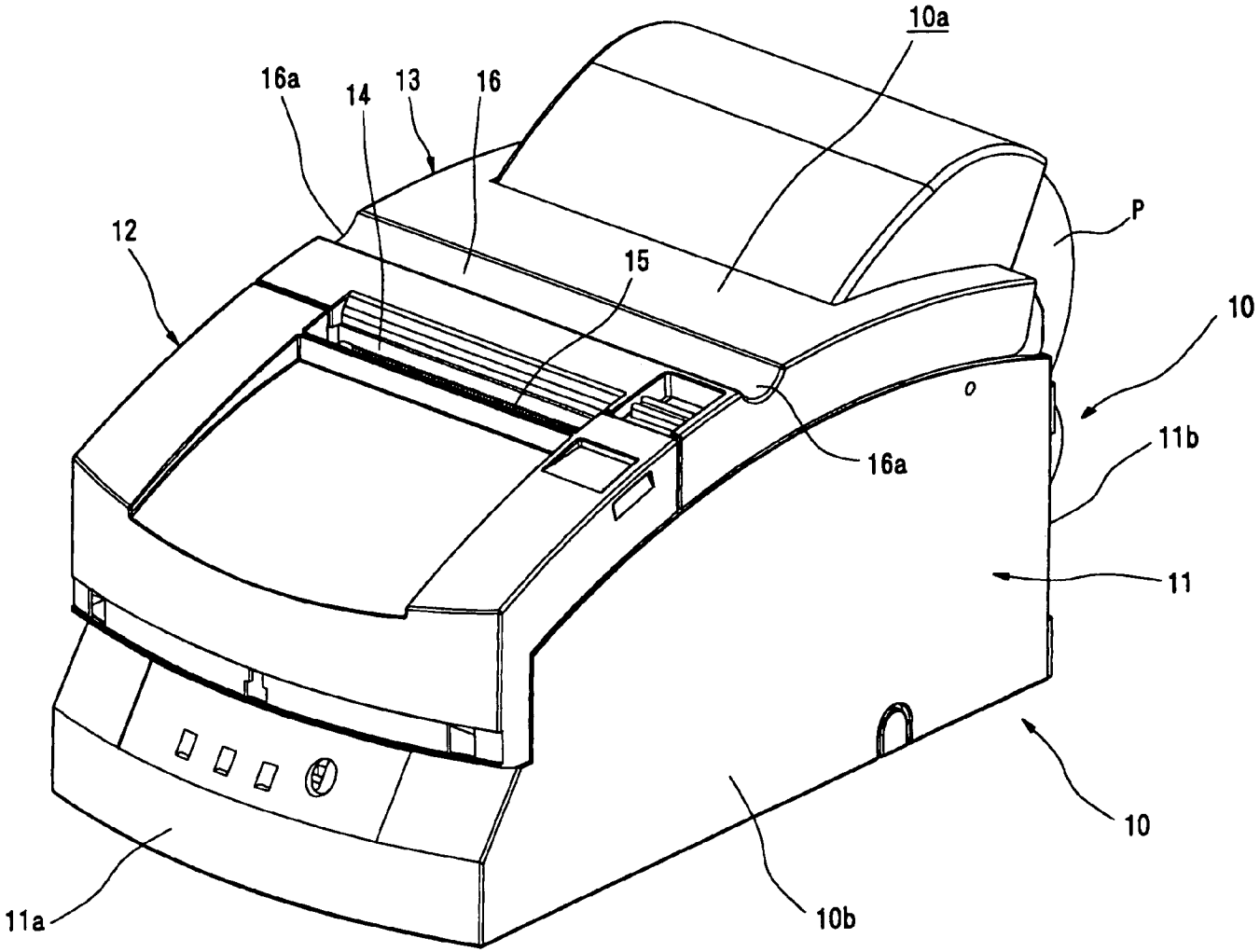
FIG. 1 is a perspective view showing the outlook of a printer according to an embodiment of the present invention.

FIG. 1 is a perspective view showing a printer according to an embodiment of the present invention. In the printer according to this embodiment, the outer shell is formed by an exterior case 10 as shown in FIG. 1. The exterior case 10 comprises a case body 11 containing main parts of the printer, and a front lid body 12 and a rear lid body 13 which cover the upper portion of the case body 11. The lid bodies 12 and 13 constitute the upper surface 10*a* of the exterior case 10, and are designed so as to be freely opened/closed.

Figure 2:
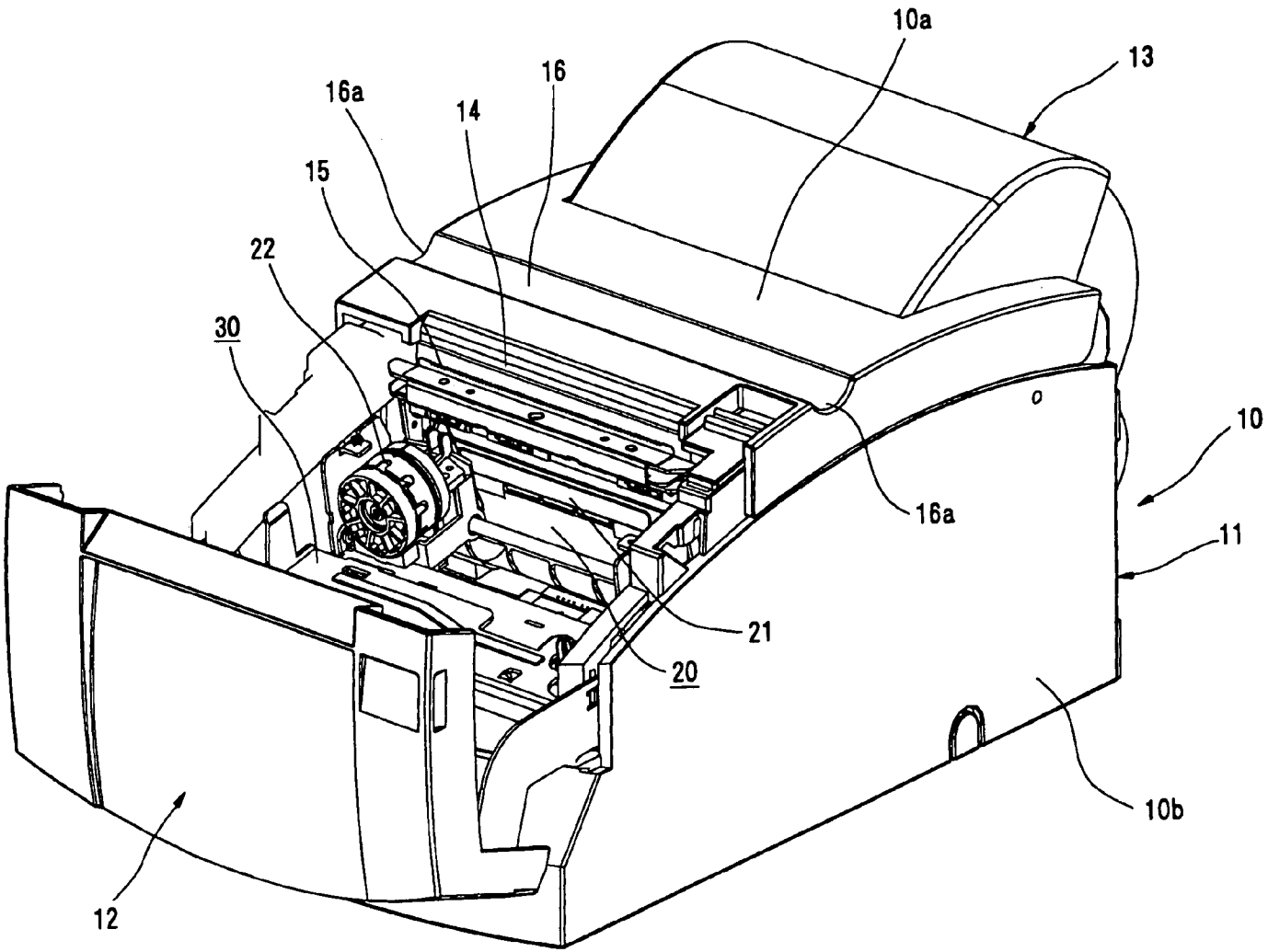
FIG. 2 is a perspective view showing the outlook of the printer when a front lid body is opened.

That is, the front lid body 12 is supported so as to be freely opened/closed (rotatable) around a fulcrum located in the neighborhood of the front portion 11*a* of the case body 11. FIG. 2 shows the printer when the front lid body 12 is opened. Furthermore, the rear lid body 13 is supported so as to be freely opened/closed (rotatable) around a fulcrum located in the neighborhood of the rear portion 11*b* of the case body 11.

In the case body 11 is provided a printer main portion containing a print portion 20, a mount portion of an ink ribbon cartridge (cartridge mount portion) 30, a roll paper mount portion (not shown), etc. As shown in FIG. 2, when the front lid body 12 is opened, the print portion 20 and the cartridge mount portion 30 can be viewed, and under this state an ink ribbon cartridge can be mounted on/detached from the cartridge mount portion 30. The print portion 20 has a platen 21 and a print head 22 which are disposed so as to confront each other. The roll paper mount portion is provided below the rear lid body 13, and roll paper (sheets) are allowed to be mounted on the roll paper mount portion under the state that the rear lid body 13 is opened.

The leading edge of the roll paper is drawn out from the rear side of the case body 11 into the gap between the platen 21 and the print head 22, and upwardly discharged in connection with rotation of a sheet feeding roller (not shown) disposed between the platen and the roll paper mount portion. In the print portion 20, the print head 22 is reciprocally moved in the width direction, and the ink ribbon held by the ink ribbon cartridge is circulated between the roll paper and the print head 22, thereby printing information on the surface of the roll paper. In this embodiment, a dot impact type print head 22 is mounted, and there is adopted a print system in which the ink ribbon is pressed against the roll paper by a wire projecting from the print head 22 to transfer ink onto the roll paper.

A sheet discharge port 14 is formed on the upper surface portion of the exterior case 10 which is located at the upper portion of the print portion 20, and printed roll paper is discharged from the sheet discharge port 14 to the outside of the case body 11. According to the printer of this embodiment, the sheet discharge port 14 is formed at the boundary portion between the front lid body 12 and the rear lid body 13. A cutter 15 having a saw-tooth type blade is disposed at the sheet discharge port 14, and apart (printed portion) of the roll paper discharged from the sheet discharge port 14 can be easily cut out by using the cutter 15.

Figure 3B:
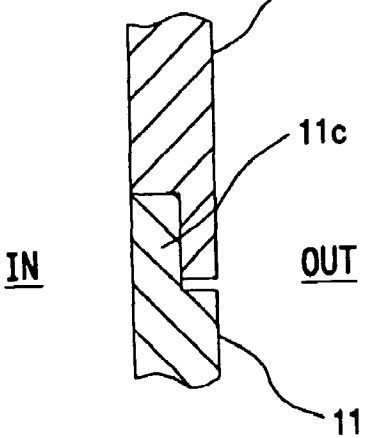
FIG. 3B is a cross-sectional view showing a structure of the engagement portion between a rear lid body and a case body.
Figure 3A:
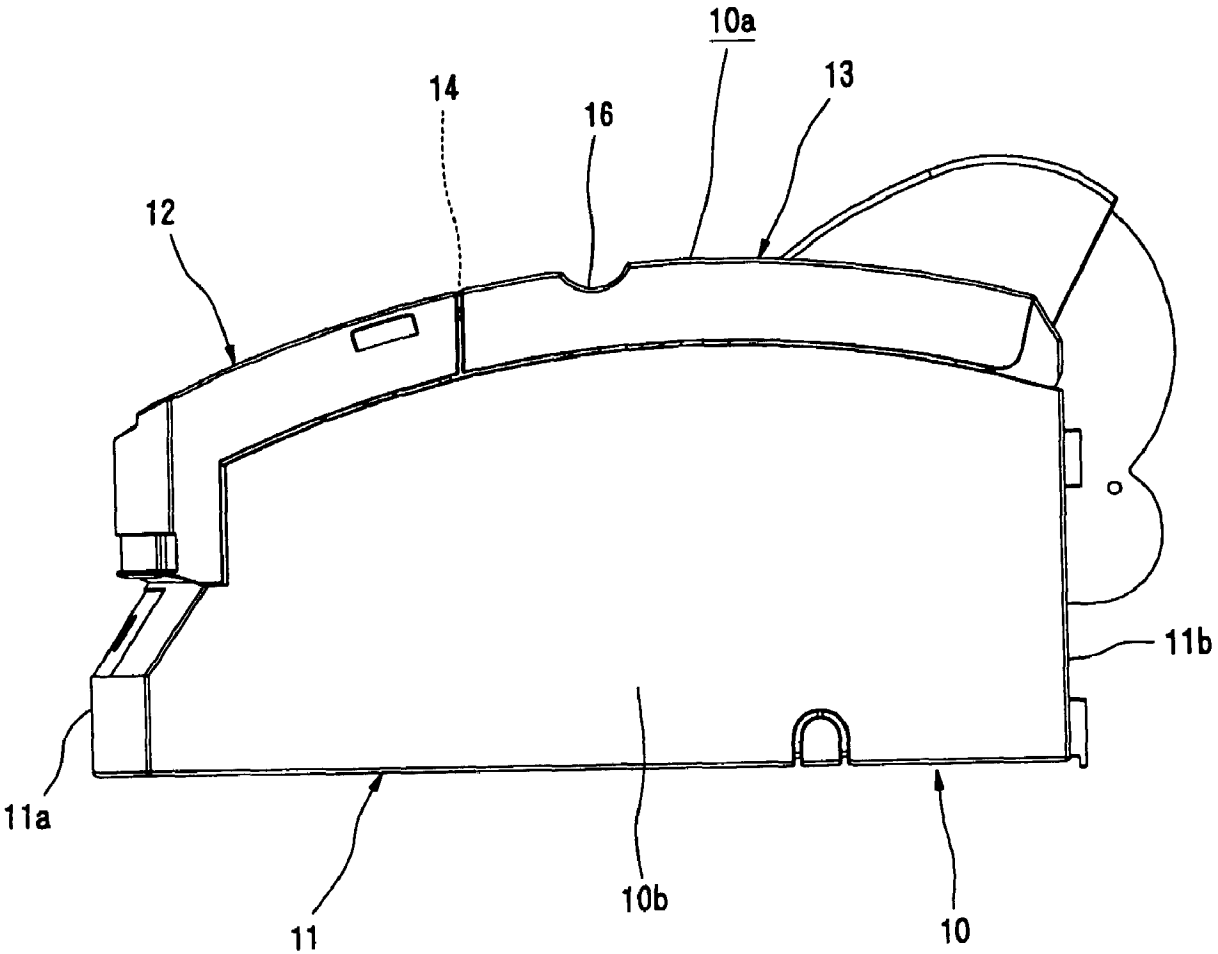
FIG. 3A is a side view of the printer.
Figure 4:
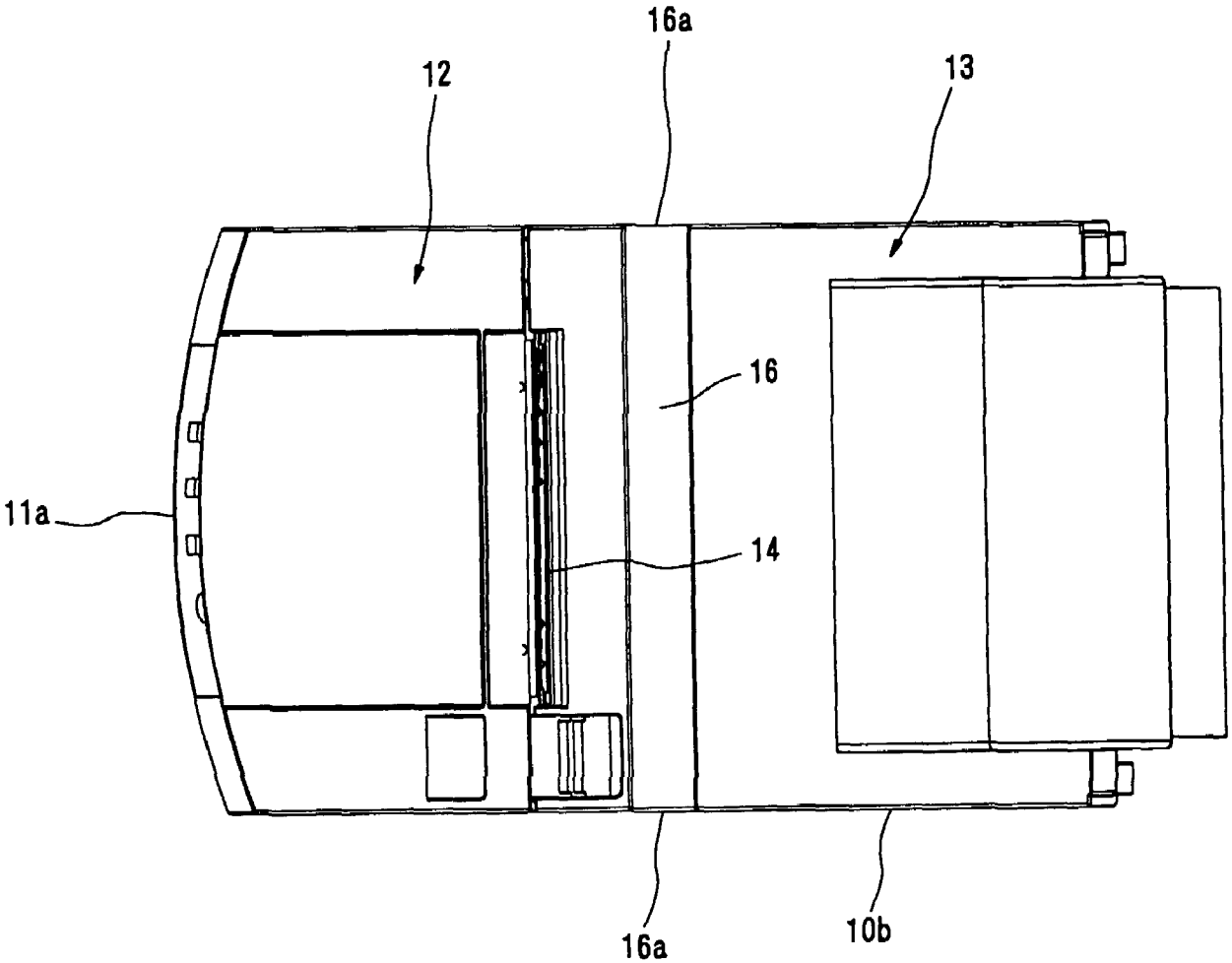
FIG. 4 is a plan view showing the printer.

FIG. 3A is a side view showing the printer according to this embodiment. As shown in FIG. 3A, the upper surface 10*a* of the exterior case 10 constructed by the front lid body 12 and the rear lid body 13 is designed as an inclined face which is forward and downward inclined from the mid portion of the rear lid body 13 to the front portion 11*a*. The sheet discharge port 14 is formed at the mid portion of the forward and downward inclined face.

In the printer thus constructed, it is considered that a foreign material such as a water droplet or the like adheres to the exterior case 10. The foreign material adhering to the exterior case 10 may move to the front portion along the inclination of the upper surface 10*a*, and invade the inside of the exterior case 10 from the sheet discharge port 14.

Therefore, according to the printer of this embodiment, a recess portion 16 for preventing invasion of foreign materials into the sheet discharge port 14 is provided on the upper surface 10*a* of the exterior case 10. In this embodiment, the recess portion 16 is formed over the overall width of the upper surface of the rear lid body 13, and both the end portions of the recess portion 16 are designed as open ends 16*a* adjacent to the side surfaces 10*b* of the exterior case 10 (see FIGS. 1 to 4). This recess portion 16 is formed so as to extend in the width direction of the exterior case 10 in proximity to the rear side of the sheet discharge port 14. The recess portion 16 is formed on the forward and downward inclined upper surface 10*a* of the exterior case 10 so as to be located at a higher position than the sheet discharge port 14. Accordingly, when a foreign material adhering to the upper surface (inclined surface) 10*a* of the exterior case 10 moves to the front side along the inclined surface, the foreign material invades the recess portion 16 and is trapped there. As shown in FIGS. 1 to 3A, the recess portion 16 is designed in a curved shape, and thus the foreign material entering the recess portion 16 falls down to the deepest portion of the recess portion 16 without being hooked at some midpoint in the recess portion 16.

When the foreign material is an object having fluidity such as a water droplet or the like, as the amount of captured foreign material increases, it moves in the width direction and is discharged from the open ends 16*a* at both the ends of the upper surface. The foreign material discharged from each open end 16*a* falls along the side surface 10*b* of the exterior case 10 to the floor surface. That is, the side surface 10*b* of the exterior case 10 forms a foreign material discharge passage through which the foreign material falls. Here, the side surface 10*b* of the exterior case 10 forming the foreign material discharge passage is designed so as to prevent invasion of foreign materials into the printer. As described above, the recess portion 16 is formed on the rear lid body 13, and the engaging portion between the rear lid body 13 and the case body 11 is designed to have a step portion by providing a higher wall 11*c* at the inner side as shown in FIG. 3B, thereby avoiding the risk that a foreign material such as a water droplet or the like invades the printer.

Figure 5:
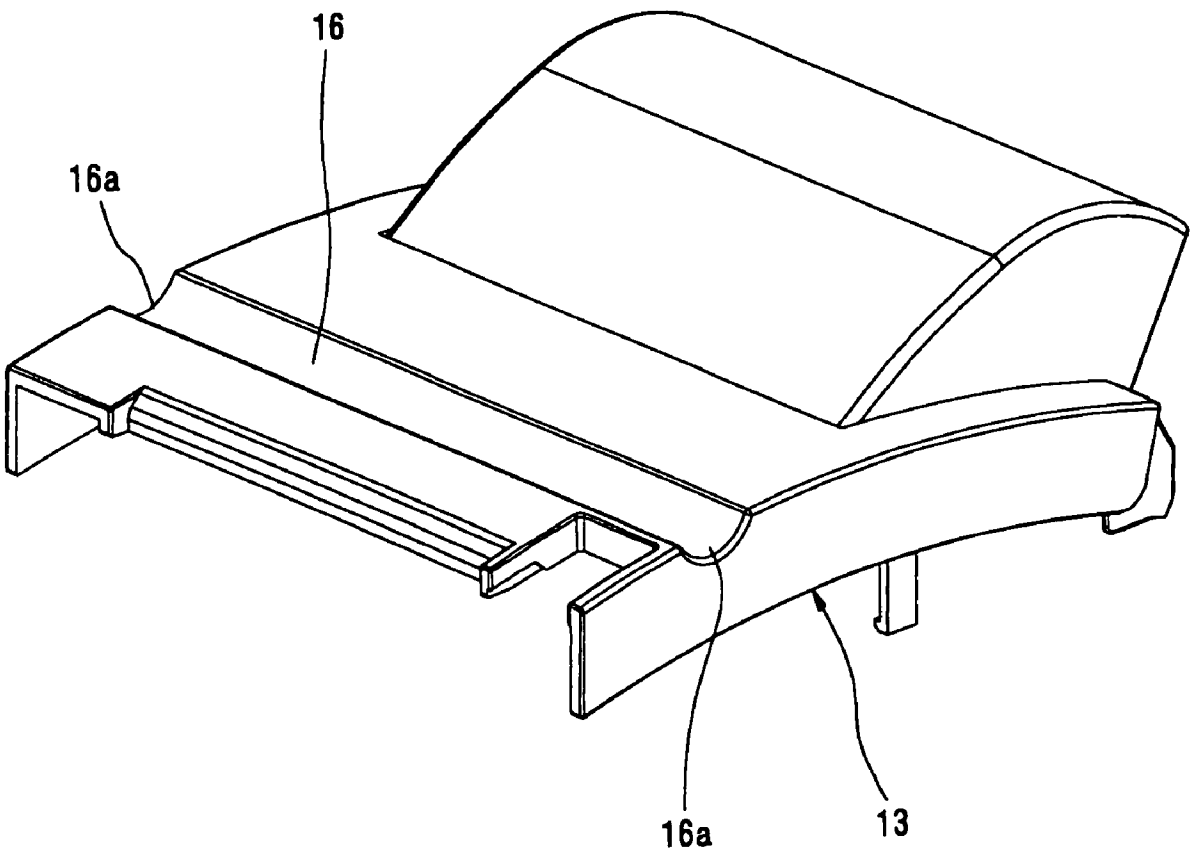
FIG. 5 is a perspective view showing the rear lid body.

As shown in FIG. 5, the rear lid body 13 may be manufactured by resin molding, and the recess portion 16 formed on the upper surface 10*a* may be formed integrally with the upper surface 10*a* without designing the metal mold in a complicated shape. Therefore, the manufacturing process is very simple, and the manufacturing cost can be reduced.

In this embodiment, the recess portion 16 is not formed at the front side of the sheet discharge port 14. The upper surface 10*a* of the exterior case 10 is designed to be inclined in the forward and downward direction at the front side of the sheet discharge port 14. Therefore, even when a foreign material adheres to this portion, the foreign material is forwardly moved by gravitation, and thus there is no risk that the foreign material invades the sheet discharge port 14.

The present invention is not limited to the above embodiment. For example, in the above embodiment, the present invention is applied to a dot impact type printer using an ink ribbon. However, the present invention may be applied to other various printers such as a laser printer, a heat transfer printer, etc. Furthermore, the present invention may be applied to a printer in which the upper surface of the exterior case is not constructed by the front and rear lid bodies.

In the above embodiment, the recess portion is formed over the overall width of the upper surface of the exterior case. However, one end of the recess portion is not required to extend to the side surface of the exterior case if the recess portion passes by the sheet discharge port, and only the other end is designed as an open end intercommunicating with the side surface of the exterior case.

Furthermore, if the bottom portion of the recess portion is sloped in the width direction so as to be downward inclined to the open end, a foreign material trapped in the recess portion is further rapidly moved to the open end by gravitation and discharged from the side surface of the exterior case, and thus this construction is more favorable.

In place of the downward inclination of the recess portion from one end to the other end, the recess portion may be downward inclined to both the open ends with the middle portion of the recess portion (preferably, the center portion near to the sheet discharge port) as the apex. In the above embodiment, the cross-sectional shape of the recess portion is a curved shape. However, the cross-sectional shape of the recess portion is not limited to a specific shape, and it may be V-shaped, rectangular or the like. In consideration of fluidity of a foreign material such as water or the like, the curved shape like the above embodiment is particularly preferable.

When the forward and downward inclined surface is not provided on the upper surface of the exterior case on which the sheet discharge port is formed, it is preferable that a recess portion passing by the front side of the sheet discharge port is also formed in the width direction, and at least one end of the recess portion is designed as an open end intercommunicating with the side surface of the exterior case. With this construction, foreign materials which are about to invade the sheet discharge port from both the front and rear sides can be prevented by the recess portions.

Figure 6:
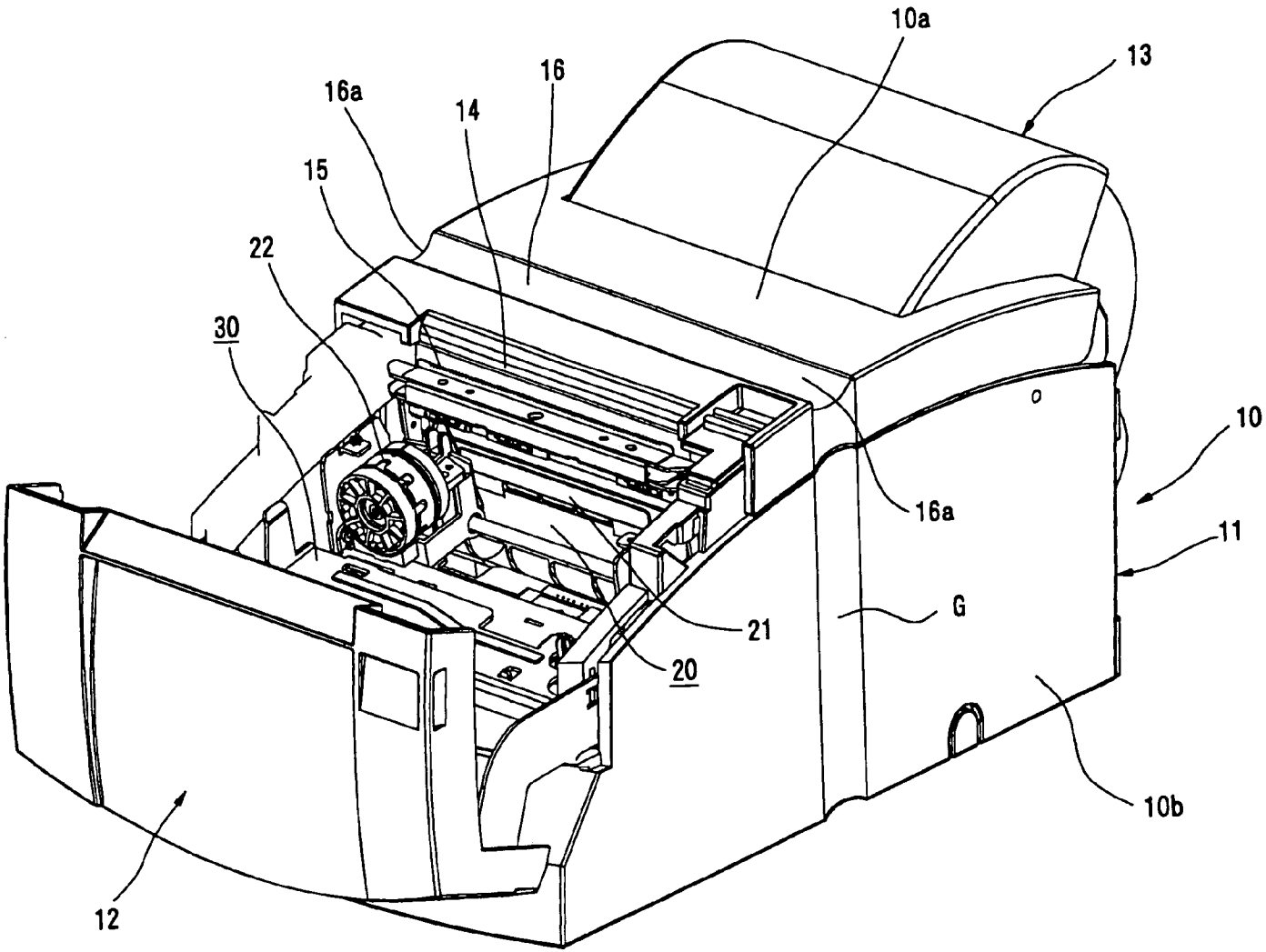
FIG. 6 is a perspective view showing the outlook of a printer according to a modification of the embodiment of the present invention.

Furthermore, in the above embodiment, the foreign material passing through the recess portion 16*a* is discharged from the open end 16*a* along the side surface 10*b* downward. In this case, a groove G along which the foreign material concerned is downward guided may be formed on the side surface 10*b* so as to intercommunicate with the open end 16*a* as shown in FIG. 6. In this case, the foreign material falling downward along the side surface 10*b* can be guided and discharged to a specific plate, and thus the side surface 10 can be prevented from being needlessly polluted by the foreign material. The cross-sectional shape of the groove G may be any shape, however, in consideration of the inter communication performance with the open end 16*a*, the cross-sectional shape of the groove G is preferably identical to that of the recess portion 16. Furthermore, if a withdrawing content for withdrawing foreign materials or the like is disposed slightly below the open end 16*a* of the side surface 10*b*, the foreign material such as water or the like can be withdrawn without dripping off. If the groove G is provided on the side surface 10*b*, such a withdrawing content may be provided at the lower end of the groove G.

According to the present invention, foreign materials adhering to the upper surface of the exterior case can be captured in the recess portion, and thus the foreign materials can be prevented from invading the sheet discharge port in advance. The structure for preventing invasion of the foreign materials is very simple because only the recess portion is formed on the upper surface of the exterior case, and thus the design and manufacturing process of the printer can be simplified, so that the manufacturing cost can be reduced.

What is claimed is:

1. A printer comprising:

a sheet discharge port provided on an upper surface of an exterior case to discharge a sheet therefrom, and a recess portion for preventing invasion of a foreign material into the sheet discharge port, provided on the upper surface of the exterior case, wherein the recess portion is formed to extend beyond the sheet discharge port in a width direction, wherein at least one end of said recess portion is opened to a side surface of the exterior case, wherein the upper surface of the exterior case has a forward and downward inclined surface, the sheet discharge port is opened to the inclined surface, and the recess portion is formed so that the open edge portion thereof is located at a higher position than the sheet discharge port, and wherein the upper surface of the exterior case is constructed by a freely openable and closable front lid body and a freely openable and closable rear lid body, the sheet discharge port is opened at the boundary portion between the front lid body and the rear lid body, and the recess portion is formed on the surface of the rear lid body.

2. The printer according to claim 1, wherein the recess portion is a groove extending in the width direction of the exterior case.

3. The printer according to claim 1, wherein the side surface of the exterior case to which the open end of the recess portion is adjacent forms a foreign material discharging passage along which the foreign material discharged from the open end of the recess portion falls down without invading the printer.

4. The printer according to claim 1, wherein the recess portion is sloped in the width direction so as to be inclined downward to the open end.

5. The printer according to claim 1, wherein the recess portion is formed so as to extend over the overall width of the upper surface of the exterior case so that both the ends thereof are opened to both the side surfaces of the exterior case.

6. The printer according to claim 1, further comprising a groove that is formed on the side surface so as to intercommunicate with the open end.

7. A printer comprising:

a sheet discharge port provided on an upper surface of an exterior case to discharge a sheet therefrom, wherein:

(a) a recess portion for preventing invasion of a foreign material into the sheet discharge port is provided on the upper surface of the exterior case, the recess portion extending beyond the sheet discharge port in a width direction and having at least one end opened to a side surface of the exterior case;

(b) the recess portion comprises a groove extending in the width direction of the exterior case;

(c) the side surface of the exterior case to which the open end of the recess portion is adjacent forms a foreign material discharge passage along which the foreign material discharged from the open end of the recess portion falls downward without invading the printer;

(d) the recess portion is sloped in the width direction so as to be inclined downward to the open end;

(e) the recess portion is formed over the overall width of the upper surface of the exterior case so that both the ends thereof are opened to both the side surfaces of the exterior case;

(f) the upper surface of the exterior case has a forward and downward inclined surface, the sheet discharge port is opened to the inclined surface and the open edge portion of the recess portion is located at a higher position than the sheet discharge port; and (g) the upper surface of the exterior case is formed by a freely openable and closable front lid body and a freely openable and closable rear lid body, the sheet discharge port is opened at the boundary portion between the front lid body and the rear lid body, and the recess portion is formed on the surface of the rear lid body.

* * * * *